US006091386A

United States Patent [19]

Bassetti et al.

[11] Patent Number: 6,091,386

[45] Date of Patent: Jul. 18, 2000

[54] EXTENDED FRAME-RATE ACCELERATION WITH GRAY-SCALING FOR MULTI-VIRTUAL-SEGMENT FLAT-PANEL DISPLAYS

[75] Inventors: Chester F. Bassetti, Danville; Vincent Chor-Fung Yu, Sunnyvale, both of Calif.

[73] Assignee: NeoMagic Corp., Santa Clara, Calif.

[21] Appl. No.: 09/103,338

[22] Filed: Jun. 23, 1998

[51] Int. Cl.[7] ..... G09G 3/36

[52] U.S. Cl. ..... 345/87; 345/89

[58] Field of Search ..... 345/87, 88, 89, 345/98, 103, 3

[56] References Cited

U.S. PATENT DOCUMENTS

| | | | |
|---|---|---|---|
| 4,845,473 | 7/1989 | Matsuhashi et al. | 345/103 |
| 5,018,076 | 5/1991 | Johary et al. | 364/518 |
| 5,185,602 | 2/1993 | Bassetti, Jr., et al. | 340/793 |
| 5,262,881 | 11/1993 | Kuwata et al. | 359/55 |
| 5,387,923 | 2/1995 | Mattison et al. | 345/103 |
| 5,422,654 | 6/1995 | Tjandrasuwita et al. | 345/103 |
| 5,448,247 | 9/1995 | Margeson, III et al. | 345/103 |
| 5,475,397 | 12/1995 | Saidi | 345/95 |
| 5,481,669 | 1/1996 | Poulton et al. | 395/164 |
| 5,537,128 | 7/1996 | Keene et al. | 345/89 |
| 5,617,113 | 4/1997 | Prince | 345/103 |

*Primary Examiner*—Richard A. Hjerpe
*Assistant Examiner*—Ronald Laneau
*Attorney, Agent, or Firm*—Stuart T. Auvinen

[57] ABSTRACT

Frame acceleration is achieved by driving multiple LCD frames to a flat-panel display for each CRT frame. Rather than divide the flat-panel display into an upper and a lower half, the panel is divided into many segments. These are physical segments when the panel is row-addressable so that any segment can be accessed at any time. Virtual segments are used for standard dual-scan panels. A buffer memory receives gray-scale converted pixels and arranges them into segment-blocks. Multiple LCD frames are generated and stored using data acceleration. Frame-rate-cycling (FRC) of these multiple frames is used for gray-scaling. The size of the buffer memory is significantly reduced by organizing the frames into three or more segments since input and output timing can be overlapped, allowing lines to be sent to the panel at a higher rate than received by the buffer. While physical segments are most efficient, virtual segments still reduce memory requirements, especially when the multiple LCD frames are repeated. Standard progressive-scan panels benefit from less flicker and more accurate gray scaling with data acceleration. When data acceleration is combined with repeating frames, higher frame acceleration is achieved with low memory requirements.

17 Claims, 9 Drawing Sheets

4X DATA ACCELERATION

| LCD Frame Displayed | 1 | 2 | 3 | 4 | 5 | 6 | 7 |
|---|---|---|---|---|---|---|---|
| Seg. A (Upper) | CRT 0 | +1 | +2 | CRT 1 | +1 | +2 | CRT 2 |
| Seg. B (Middle) | -2 | CRT 0 | +1 | +2 | CRT 1 | +1 | +2 |
| Seg. C (Lower) | -1 | -2 | CRT 0 | +1 | +2 | CRT 1 | +1 |

LCD Display Source: 3-Segment Display

Fig. 12A

| LCD Frame → | 1 | | 2 | | 3 | | 4 | | 5 | |
|---|---|---|---|---|---|---|---|---|---|---|
| Memory Blocks | Read | Write | Read | Write | Read | Write | Read | Write | Read | Write |
| CRT-to-LCD Direct Path | Seg. A CRT 0 | | Seg. B CRT 0 | | Seg. C CRT 0 | | Seg. A CRT 1 | | Seg. B CRT 1 | |
| Mem. Buffer X | B-2 | A+1 | A+1 | B+2 | (B+2) | | B+2 | A+1 | A+1 | B+2 |
| Mem. Buffer Y | C-1 | A+2 | (A+2) | | A+2 | C+1 | C+1 | A+2 | (A+2) | |
| Mem. Buffer Z | (C-2) | | C-2 | B+1 | B+1 | C+2 | (C+2) | | C+2 | B+1 |

Buffer Memory Contents: 3-Segment Display

Fig. 12B

| LCD Frame Displayed | 1 | 2 | 3 | 4 | 5 | 6 | 7 | 8 | 9 |
|---|---|---|---|---|---|---|---|---|---|
| Seg. A | CRT 0 | +1 | +2 | +3 | CRT 1 | +1 | +2 | +3 | CRT 2 |
| Seg. B | -3 | CRT 0 | +1 | +2 | +3 | CRT 1 | +1 | +2 | +3 |
| Seg. C | -2 | -3 | CRT 0 | +1 | +2 | +3 | CRT 1 | +1 | +2 |
| Seg. D | -1 | -2 | -3 | CRT0 | +1 | +2 | +3 | CRT 1 | +1 |

LCD Display Source: 4-Segment Display

Fig. 14

| Input CRT Frame(Seg) | I(A) | I(B) | I(C) | I(D) | I(E) | II(A) | II(B) | II(C) | II(D) | II(E) |
|---|---|---|---|---|---|---|---|---|---|---|
| LCD Frames Stored | 2A, 3A, 4A | 3B, 4B | 2C, 3C, 4C | 3D, 4D | 2D, 3D, 4D | 5A, 6A | 5B, 6B, 7B | 5C, 6C | 5D, 6D, 7D | 5E, 6E |
| Seg. A | 1 | 2 | 2 | 3 | 3 | 4 | 4 | 5 | 5 | 6 |
| Seg. B | 1 | 2 | 2 | 3 | 3 | 4 | 4 | 5 | 5 | 6 |
| Seg. C | 0 | 1 | 1 | 2 | 2 | 3 | 3 | 4 | 4 | 5 |
| Seg. D | 0 | 1 | 1 | 2 | 2 | 3 | 3 | 4 | 4 | 5 |
| Seg. E | -1 | 0 | 0 | 1 | 1 | 2 | 2 | 3 | 3 | 4 |
| # Mem Blks in Use | 14 | 11 | 14 | 11 | 14 | 11 | 14 | 11 | 14 | 11 |

Odd Frame Accel., Data Repeat, Progressive Scan

Fig. 15

| Frame Accel → | 2x | 3x | 4x | 5x | 6x | 7x | 8x | 9x |
|---|---|---|---|---|---|---|---|---|
| Seg. Frame/Data Accel. | .5 Frm | 1 | 1 ½ | 2 | 2 ½ | 3 | 3 ½ | 4 |
| Progressive Frm/Data Accel. | .5 Frm | 3 | 3 ½ | 4 | 4 ½ | 5 | 5 ½ | 6 |
| Repeat Seg. Frm Accel. | .5 Frm | 2/3 | 3/4 | 4/5 | 5/6 | 6/7 | 7/8 | 8/9 |

Fig. 16

EXTENDED FRAME-RATE ACCELERATION WITH GRAY-SCALING FOR MULTI-VIRTUAL-SEGMENT FLAT-PANEL DISPLAYS

FIELD OF THE INVENTION

This invention relates to computer graphics systems, and more particularly to minimizing memory requirements for frame acceleration of flat-panel displays.

BACKGROUND OF THE INVENTION

Flat-panel displays are widely used for portable computers such as laptop and notebook personal computers (PCs). Super-twisted nematic (STN) liquid-crystal displays (LCDs) are relatively inexpensive. To increase the contrast ratio of these displays, the amount of time pixels are driven on or off, and the overall duty cycle is decreased by splitting the display into two halves. Each of these two halves is independently driven so that two rows of pixels are illuminated at any instant in time.

Additional memory, called a half-frame buffer (HFB), is used to store pixels driven to the split display. The incoming pixels are sent to both the half-frame buffer and one half of the display. Once all pixels for the display-half are sent, then the buffer drives the same pixels to that display half, while pixels for the other display-half are received by the buffer and simultaneously sent to the other display half. Thus two streams are simultaneously sent to the display—one stream for each display-half.

FIG. 1 is a diagram of a prior-art display system using a half-frame buffer. Pixel pipeline 12 receives a stream of pixels from a frame-buffer memory (not shown) and converts these pixels for display by cathode-ray tube (CRT) 10. Colors may be re-mapped by pixel pipeline 12 and attributes such as blinking cursors added. The pixel stream to CRT 10 is tapped off and sent to gray-scale converter 14 for display on a flat panel LCD.

Unlike CRTs, some flat-panel displays such as Dual-STN LCD's are single-bit digital devices that can only display a pixel as fully on or fully off. CRTs are analog devices that can display shades of pixels by increasing or decreasing the intensity of a displayed pixel or its color components. Gray-scale converter 14 converts multi-bit pixel intensities for an analog display to single-bit digital (on or off) pixels. The digital on/off pixels are sent directly to upper panel-half 20 and to half-frame buffer 16. Half-frame buffer 16 simultaneously sends buffered pixels for lower panel-half 22.

Once all pixels for upper panel-half 20 have been sent and stored by half-frame buffer 16, then pixel connections are swapped and half-frame buffer 16 drives the buffered pixels to upper panel-half 20, while the incoming pixels from gray-scale converter 14 are sent to lower panel-half 22. These incoming pixels are also stored in half-frame buffer 16.

Storage space is freed in half-frame buffer 16 as the buffered pixels are sent to upper panel-half 22. Thus a total storage of about one-half a frame of pixels is required for half-frame buffer 16. The pixels sent to half-frame buffer 16 do not have to be identical to the pixels simultaneously sent to the flat panel. Instead, pixels from the next frame can be sent to half-frame buffer 16 while pixels from the current frame are sent directly to the panel. This results in frame acceleration, since double the number of flat-panel frames are displayed for each CRT frame. Flicker is reduced.

Three Half-Frame Buffers—FIG. 2

FIG. 2 is a prior-art graphics system using three half-frame buffers. Calculating row and column data applied to a flat-panel display may be complex, requiring that the last frame of data be stored for use in calculations. Prince in U.S. Pat. No. 5,617,113, assigned to In Focus Systems of Wilsonville Oreg., discloses storing the entire last frame of data in addition to the current half-frame buffer. Memory requirements are reduced from two complete frames to one and a half frames using Prince's system, although a non-conventional, multi-bit-pixel frame-rate cycling (FRC) scheme is used.

Incoming pixels are gray-scale converted and routed to one of three half-frame buffers 24, 26, 28. These buffers may be read (not shown) during gray-scale calculations. Multiplexers 31, 33 each select converted pixels from one of half-frame buffers 24, 26, 28 for display on panel-halves 20, 22. At any point in time, one of half-frame buffers 24, 26, 28 is receiving incoming data, while another buffer is sending pixels to upper panel-half 20 while the remaining buffer is sending data to lower panel-half 22. Buffers 24, 26, 28 rotate their functions after each half-frame of pixels is received.

The complex calculations made in this prior-art scheme use three half-frame buffers, or 1.5 frames of memory. Only 2x frame acceleration is achieved using 1.5 frames of memory. Thus memory efficiency is less than standard techniques that achieve the same frame acceleration.

A common gray-scaling technique is known as frame-rate cycling (FRC). A pixel's shading is approximated by blinking the pixel on and off over a cycle of several frames. For example, a 50% gray can be approximated by turning the pixel on for one frame, but off for the next frame. The gray-scale converter can send an on pixel directly to the display, but write an off pixel to the half-frame buffer for display in the next frame.

Technology is improving the response speed of the liquid-crystal fluid in an LCD panel. Faster LCD fluid allows better rendition of rapidly-moving images encountered with multimedia movie clips and animations. Unfortunately, with the faster LCD fluid the contrast ratio becomes worsened and the grayscale flicker becomes noticeable. To counteract these problems with fast LCD fluids, these displays can be refreshed at faster rates, improving image quality. Pixel data can be sent to these displays at higher rates. While simply buffering pixel data and re-transmitting it at the higher rates improves the contrast ratio, it does not reduce flicker. Generating many frames of gray-scale data could result in large memory-storage use. Improved techniques are desired that take advantage of the faster flat-panel displays, yet are memory-efficient.

What is desired is a graphics system for high-bandwidth and high-refresh-rate flat-panel displays. It is desired to use frame-rate-cycling gray-scaling, but minimize the memory required for buffering. More efficient data-handling techniques and timing are desired.

SUMMARY OF THE INVENTION

A method provides N-frame acceleration to a display of N segments. During each of N time-periods pixels are transferred from current segment of an input frame to a current segment of the display. Pixels are stored from the current frame of the input frame in a memory containing a plurality of segment-buffers. The pixels are stored for display in a subsequent N−1 time periods in N−1 segment-buffers.

Stored pixels are read from N−1 segment-buffers that were stored in a previous N−1 time-periods. The stored pixels are transferred to the display to all N−1 segments of the display except the current segment.

The method advances to a next current segment of the input frame. When the current segment is a last segment of the input frame, it advances to a first segment of a next frame. Thus N segments are refreshed for each of N time-periods.

In further aspects of the invention a different group of N−1 segment-buffers are read and written for each time-period of the input frame. The memory includes $(N^2-N)/2$ segment-buffers.

In still further aspects a segment-buffer is read and written to during the current time-period. Thus stored pixels are read out of segment-buffers as new pixels are being written in.

BRIEF DESCRIPTION OF THE DRAWINGS

FIGS. 12A, 12B are tables showing how data is stored in memory buffers and displayed to a flat-panel display with three virtual segments.

FIG. 14 is a table showing how data is displayed to the flat-panel display system of FIG. 13 with four virtual segments.

FIG. 15 shows 5x frame acceleration using 2.5x data acceleration and 2x data repeat.

FIG. 16 is a table comparing buffer memory requirements for various kinds and degrees of frame accelerations.

DETAILED DESCRIPTION

The present invention relates to an improvement in flat-panel graphics systems. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventor has realized that a flat-panel display can be divided into more that just two sections or segments. Dividing the panel into two segments results in a doubling of the overall display bandwidth which can easily be taken advantage of using the half-frame buffer technique to increase the refresh rate since each of the half-panel segments are refreshed simultaneously. Further dividing the panel into four or more segments can result in a quadrupling of the overall refresh rate. Unfortunately, achieving four vertical splits in a panel is not currently feasible, because there is no known way to route the column driver signals to the inner panel segments. However, the inventor has realized dual-scan panels can be divided into many "virtual" segments to achieve this effect of multi-segment panels.

Figure 1:
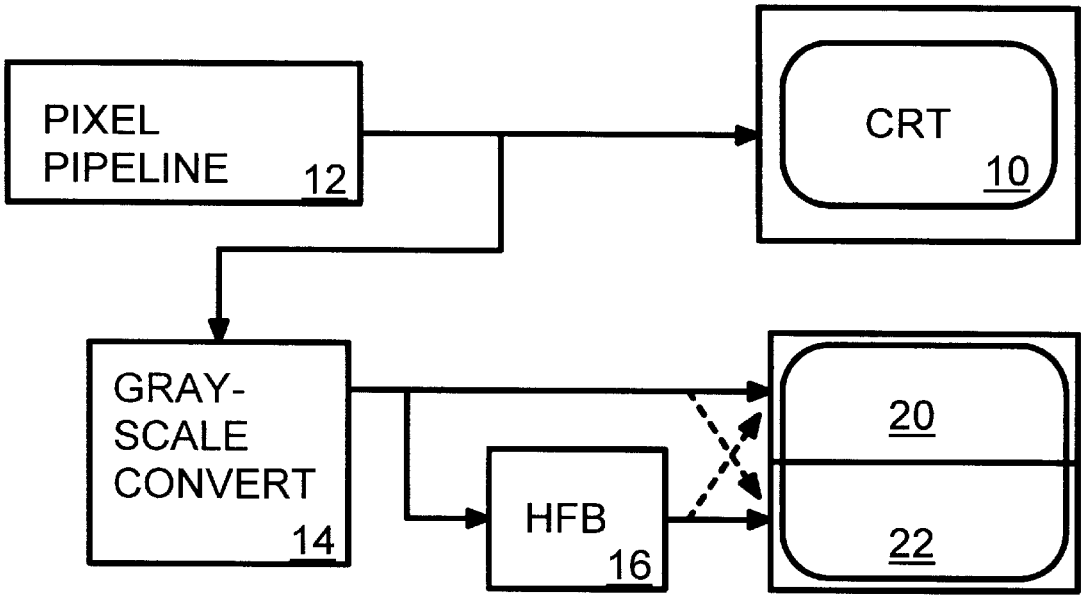
PRIOR ART FIG. 1
FIG. 1 is a diagram of a prior-art display system using a half-frame buffer.
Figure 2:
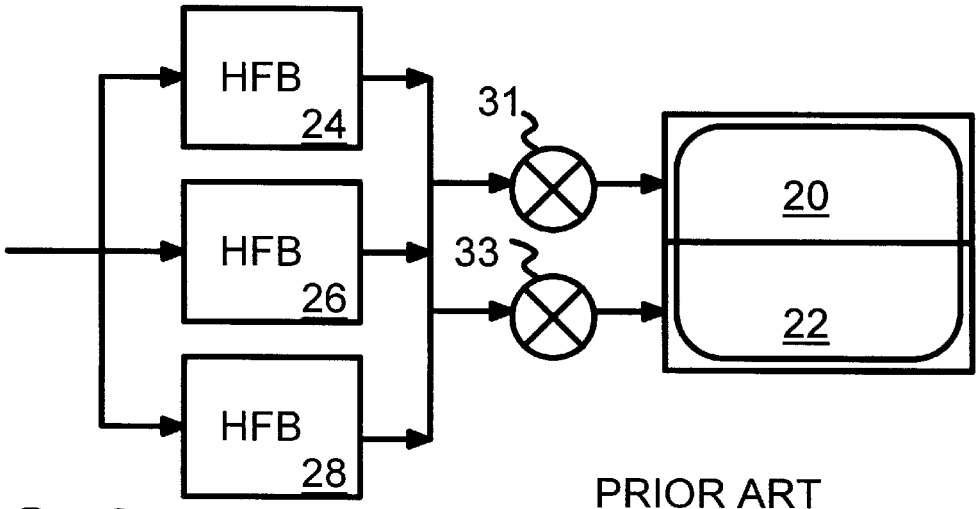
PRIOR ART FIG. 2
FIG. 2 is a prior-art graphics system using three half-frame buffers.
Figure 3:
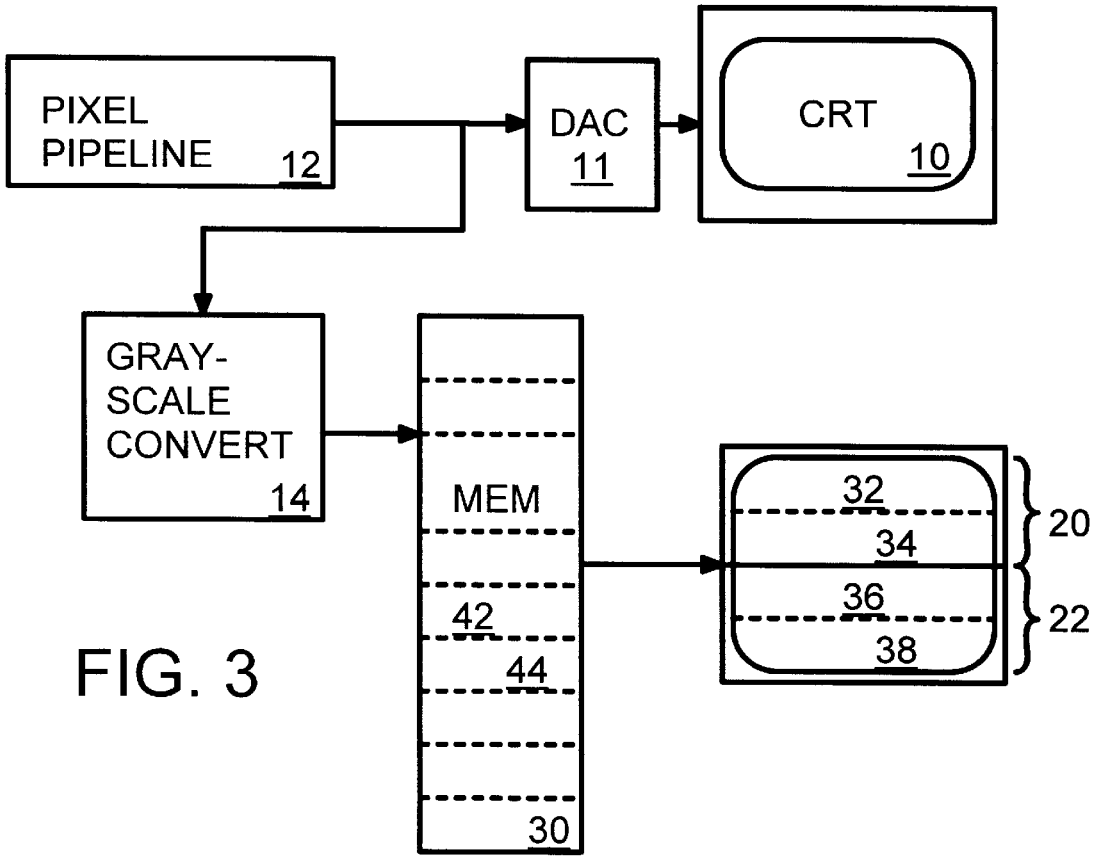
FIG. 3 shows a flat-panel graphics system using multiple virtual segments.

FIG. 3 shows a flat-panel graphics system using multiple virtual segments. Pixel pipeline 12 generates multi-bit pixels that encode color intensity. These multi-bit pixels are converted to analog voltages by digital-to-analog converter DAC 11 and sent to CRT 10. The multi-bit pixels are converted to single-bit digital on/off pixels by gray-scale converter 14. The color intensities are converted to on or off pixels over time.

Multiple frames of pixels are generated from each incoming CRT frame. Shading is accomplished by turning pixels on and off over the multiple frames.

While the term "gray" scaling is still used, this shading technique is applied to color displays as well as black-and-white monochrome displays. The shading technique is applied to the three primary color components (red, green, blue) to achieve color shades.

The converted gray-scale pixels are stored in buffer memory 30. Multiple frames of pixels are stored for each incoming CRT frame. Buffer memory 30 may be part of a larger memory such as a frame buffer that feeds pixels to pixel pipeline 12. A large multi-use embedded memory is preferred as memory space can be allocated as needed. See for example "Graphics Controller Integrated Circuit Without Memory Interface", U.S. Pat. No. 5,650,955.

The flat-panel display is a dual-scan display with upper panel-half 20 and lower panel-half 22. However, this panel is further divided into multiple virtual segments 32, 34, 36, 38. In the example of FIG. 3, the panel is divided into four segments, each a quarter-frame in size. Segments 42, 44 stored in buffer memory 30 are quarter-frame blocks of pixels for writing to segments 32, 34 in the flat-panel display.

While a buffer memory before gray-scale converter 14 could be used, the memory size required is larger since pixel intensities rather than digital on/off pixels are stored. Typically 24-bit pixels are used by pixel pipeline 12, which allows for an 8-bit intensity for each of the three RGB color components. Gray-scale converter 14 converts each 8-bit intensity to a one-bit color component—either on or off—for each LCD frame. Thus memory 30 stores each digital on/off pixel as three bits—one bit for each color component.

Figure 4:
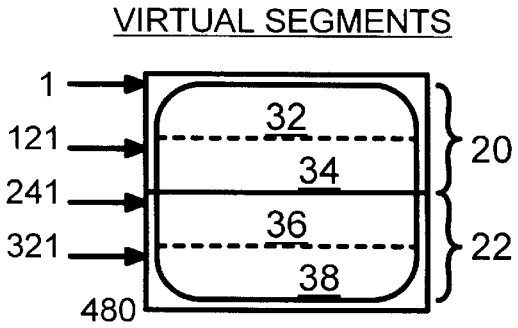
FIG. 4 illustrates a flat-panel display divided into four virtual segments.

Virtual Segments—FIG. 4

FIG. 4 illustrates a flat-panel display divided into four virtual segments. The flat-panel display is a dual-scan display with upper panel-half 20 and lower panel-half 22. This panel is further divided into multiple virtual segments 32, 34, 36, 38.

Rows in the display can be individually addressed. Although such panels are not currently available as commercial products, constructing such a panel requires that the shift register that drives the rows of the panel be replaced by addressable registers or some other means to jump back and forth to rows being scanned in each of the virtual segments. Pixel data are scanned almost simultaneously to all four segments 32, 34, 36, 38 of the display. First, the pixels for line 1 (first segment 32) are sent to upper panel-half 20, while pixels for line 241, the first line of third segment 36 are sent to lower panel-half 22. The row drivers for line 1 and 241 are driven "on". Then, the pixels for line 121, the first line of second segment 34, are sent to upper panel-half 20, while pixels for line 321 , the first line of fourth segment 36, are sent to lower panel-half 22. The row drivers for lines 1 and 241 are driven "off" while lines 121 and 321 are driven "on"

Then lines 2 and 242, followed by lines 122 and 322 are scanned into the flat panel display. This pattern is repeated 120 times until all 120 lines or rows of each segment have been scanned in. At that point the next frame begins with lines 1 and 241. This example is for a 640×480 line display; other display resolutions use different sequences of rows.

Figure 5:
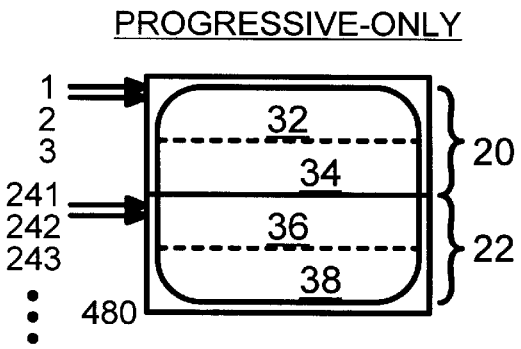
FIG. 5 shows progressive scanning of four virtual segments.

Progressive Scanning of Segments—FIG. 5

Most displays do not allow random addressing of rows. Instead, the rows of each panel-half must be scanned progressively, in order, from the first row to the last row. Multiple virtual segments can still be employed with progressive scanning displays, although memory organization and timing are less efficient.

FIG. 5 shows progressive scanning of four virtual segments. Since no address lines are input to the flat-panel display, the rows of pixels must be sent in order, from the top line to the bottom line in each panel-half. Pixels are simultaneously sent for line 1 of upper panel-half 20 and for line 241, the first line of lower panel-half 22. Once these lines have been sent, pixels for lines 2 and 242 are sent, followed by lines 3 and 243. The sequence is repeated 240 times until all 480 lines have been sent.

Pixel data for second virtual segment 34 is sent for rows 121 to 240, while data for fourth segment 38 is sent for rows 321 to 480. While the display is operated as a dual-scan display with two halves, the data is organized in memory as four virtual segments. More memory is required for buffering progressive displays than for randomly-addressable displays since the CRT data is received at different times that when the LCD data is being written to the segments.

Figure 6:
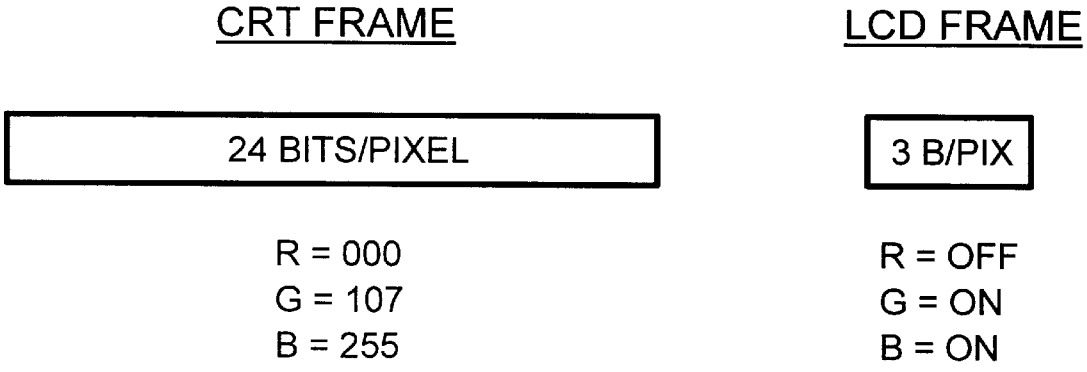
FIG. 6 shows that CRT pixels are stored in a 24-bit format while LCD pixels are stored in a 3-bit format.

LCD Pixels Stored in 3-Bit Format—FIG. 6

FIG. 6 shows that CRT pixels are stored in a 24-bit format while LCD pixels are stored in a 3-bit format. Eight bits are used to indicate the intensity of each color component in the 24-bit-per-pixel format. For example, when the R component is 000, G is 107, and B is 255, then red is off, blue in fully on, and green is not quite halfway on. This is a blue-green color shade.

Upon gray-scale conversion, the 24-bit format is reduced to only 3 bit. These 3 bits indicate when each of the R,G,B color components are on or off. The blue-green color (000, 107,255) is converted to (0,1,1). This has red off bit both blue and green fully on. The color conversion is not exact since the gray-scale converted pixel has more green (50%) than the 24-bit pixel.

Figure 7:
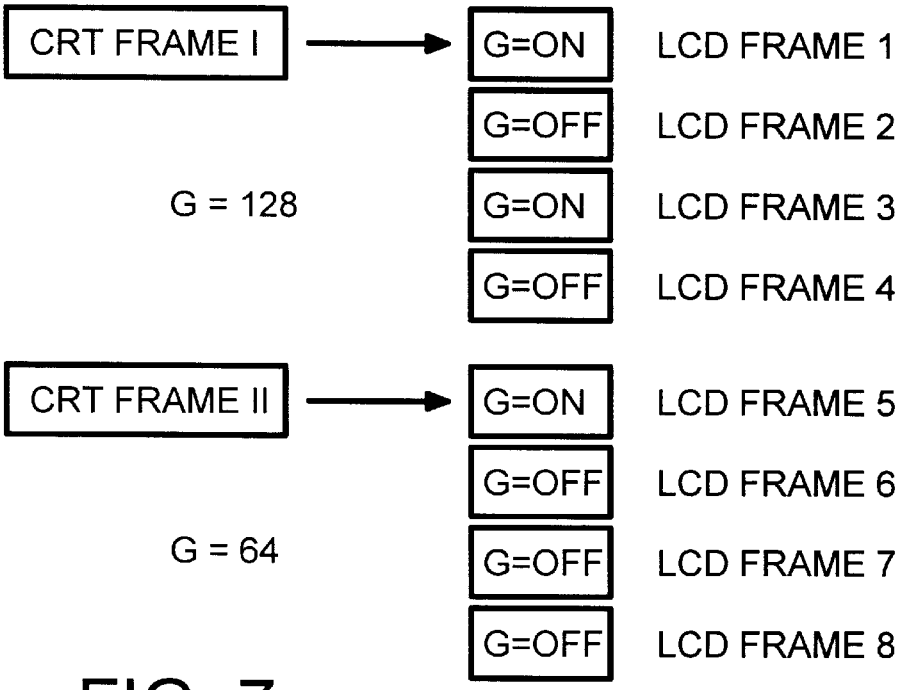
FIG. 7 shows that each input CRT frame is converted to four LCD frames using data acceleration.

Data Acceleration and FRC—FIG. 7

Frame data acceleration reduces flicker, since multiple frames are generated for each input CRT frame. When four frames are generated for each input CRT frame, as shown in FIG. 7, then gray-scale conversion can be more accurate for moving images. FIG. 7 shows that each input CRT frame is converted to four LCD frames using data acceleration.

CRT frame I is converted by gray-scale conversion to four LCD frames 1, 2, 3, 4. While CRT frames use a 24-bit-per-pixel format, LCD frames use 3-bits-per-pixel. CRT frame II, the next frame from the frame buffer and pixel pipeline, is likewise converted to four LCD frames 5, 6, 7, 8. The LCD frames are sent to the flat panel at four times the rate of the CRT frames. Thus a data acceleration of 4x is accomplished by the gray-scale converter generating four LCD frames for every CRT frame. The LCD panel is refreshed at four times the CRT rate, for a frame acceleration of 4x.

Frame-rate cycling (FRC) is used to approximate color shades. For example, when the green component G is 107, it can be approximated as shown in FIG. 7. For CRT frame I, G=128 is converted to LCD frames that have G on 50% of the time. LCD frames 1 and 3 have G on, but LCD frames 2 and 4 have G off.

CRT frame 2 has G=64, one-quarter of the full 255 value. LCD frame 5 has G on, but LCD frames 6, 7, 8 have G off. Thus G is on 25% of the time.

When G=107, it could be approximated by either G=128 or G=64. These are better approximations than FIG. 6, which approximates G=107 as fully on (G=255). Increasing the data acceleration by using more frames results in better shading approximations for moving images, since intermediate values can be generated. For example, if 8 frames were generated per CRT frame, then G=96 could be generated, a still better approximation for G=107 than G=128 or G=64, the closest value available for 4x data acceleration.

Figure 8:
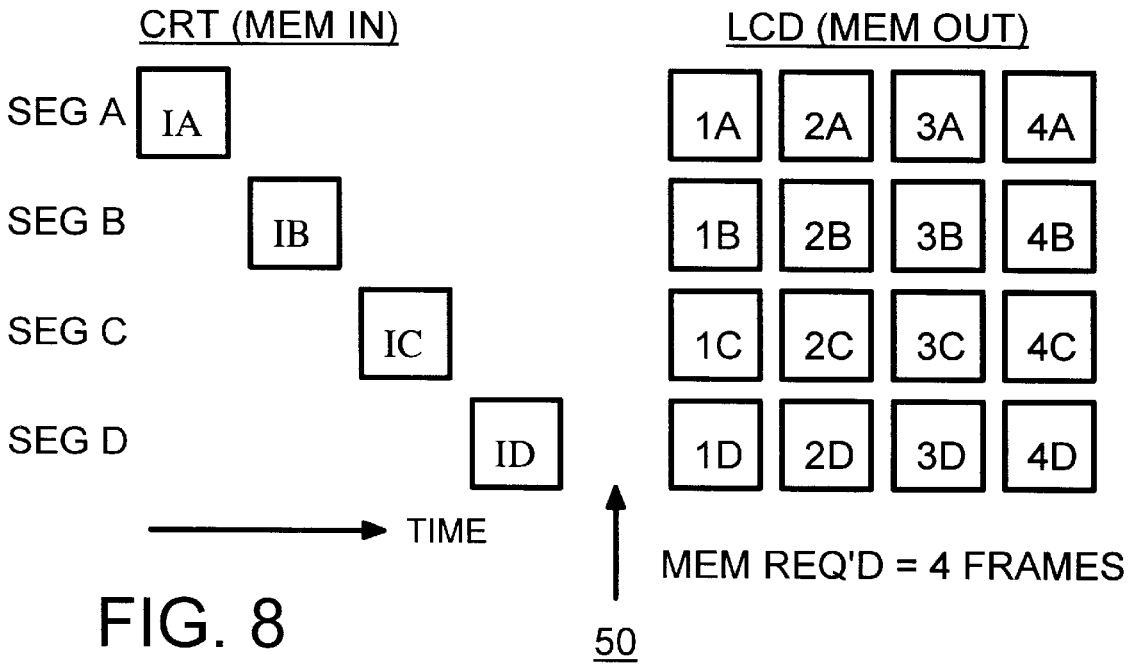
FIG. 8 shows that 4 frames of memory are required to buffer four LCD frames generated by 4x data acceleration.
Figure 9:
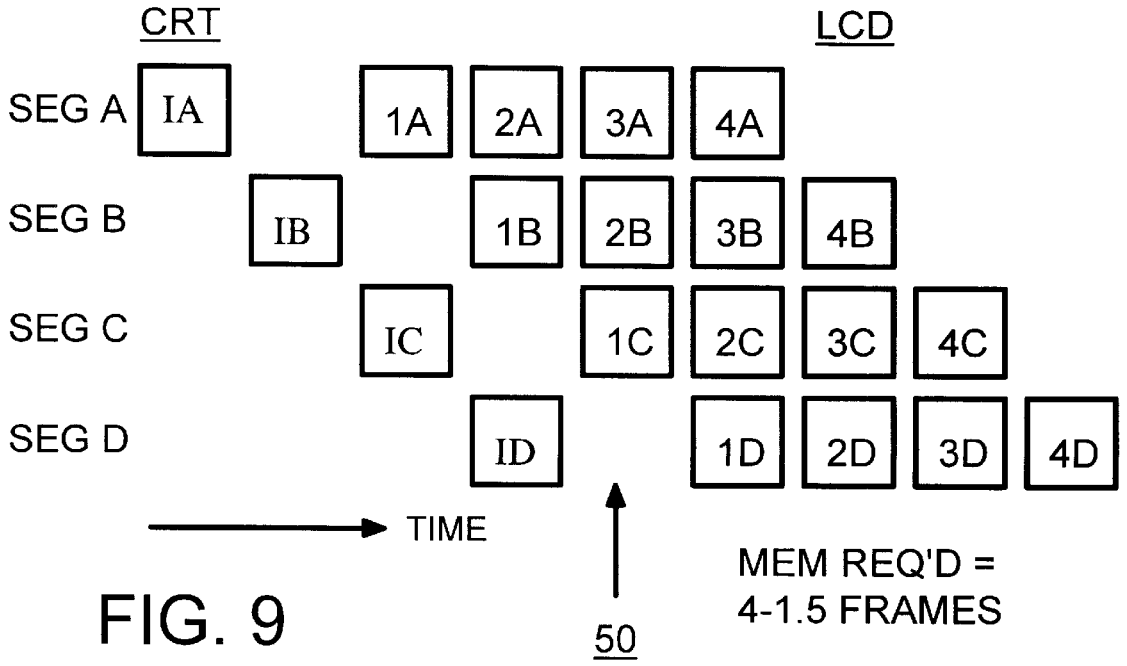
FIG. 9 shows that the buffer memory required is less when CRT and LCD timing is overlapped.

Buffer Memory Requirements—FIGS. 8, 9

FIG. 8 shows that 4 frames of memory are required to buffer four LCD frames generated by 4x data acceleration. Four virtual segments A, B, C, D are used. The 24-bit pixel data is scanned to the CRT over a CRT-refresh period of time. CRT frame I arrives over time as lines in the four virtual segments are scanned. The first CRT data received is for the first segment, "IA", followed by the second virtual segment "IB", and the third and fourth segments "IC", "ID". As these segments are input to the gray-scale converter, four frames of data are generated for 4x data acceleration. The first s LCD frame is 1A, 1B, 1C, 1D, while the last LCD frame is designated 4A, 4B, 4C, 4D.

The first CRT segment generated LCD frame-segments 1A, 2A, 3A, 4A. These are the first segments for the four LCD frames. Likewise other CRT segments generate their respective LCD segments, all designated by the same letter in FIG. 8.

A straightforward implementation with no timing overlap requires that all four LCD frames be stored. At time 50, after the last segment of CRT data is received, none of the LCD frames has yet been displayed, so all 4 LCD frames must be stored in the buffer memory.

FIG. 9 shows that the buffer memory required is less when CRT and LCD timing is overlapped. In FIG. 9, display of the LCD frames begins before all of the CRT frame has been received. Display of the four segments is staggered in time. Each segment is displayed two LCD-frame periods (one half a CRT-frame period) after the segment's CRT data is received. Thus segment 1A is displayed on the LCD while segment IC of the CRT input is being received. Segments 2A and 1B are displayed while CRT segment 1D is being received.

At time 50, after all the CRT data is received, LCD segments 3A, 2B, and 1C are being displayed. Segment 4D of the previous CRT frame is also being displayed at time 50. The following LCD-frame period, segments 4A, 3B, 2C, and 1D are displayed. At that point, the first segments (A) for all four frames have been displayed, but for the fourth segment (D), only one of the frames has been displayed.

The buffer memory required is reduced since some of the segments have already been displayed and no longer have to be stored. For example, at time 50, segments 1A, 2A, and 1B have been displayed on the LCD panel, and their data can be discarded. Segments 3A, 2B, and 1C are being displayed at time 50 so their memory is being freed up as each line of pixels is displayed. New pixel data for the next frame can be written to these memory blocks as soon as the old line has been read. Thus the memory blocks for segments 3A, 2B, and 1C can be used in the same cycle (at time 50) for new data.

Overall, six memory blocks are available at time 50, since segments 1A, 2A, 3A, 1B, 2B and 1C have been or are being displayed on the flat panel. Thus the memory required is reduced by six segment-blocks. Since each segment-block is one-quarter of a frame in size, a savings of 1.5 frames results from the timing overlap. Only 2.5 LCD frames of memory must be available for buffering, instead of four full LCD frames. Even though both examples use 4x data buffering and have the benefits of better gray-scale conversion, timing overlap reduces the memory required.

Figure 10:
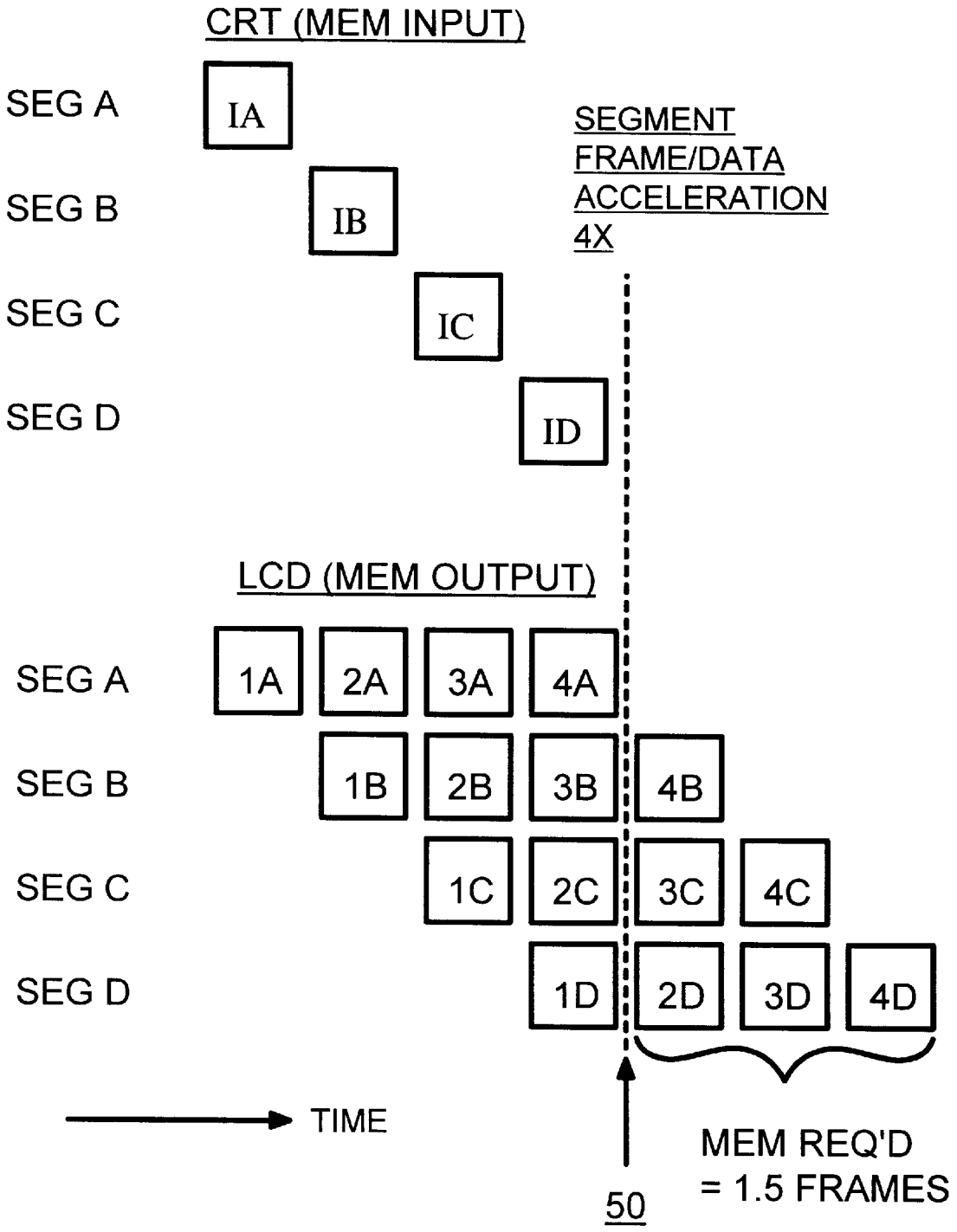
FIG. 10 shows that immediate display of incoming CRT data on the flat-panel display requires only 1.5 frames of storage when four virtual segments and four LCD frames are generated.

Timing Overlap Reduces Buffer Memory—FIG. 10

FIG. 10 shows that immediate display of incoming CRT data on the flat-panel display requires only 1.5 frames of storage when four virtual segments and four LCD frames are generated. In this example, gray-scale conversion is quick, allowing the incoming CRT data to be converted and displayed before the next segment begins. When CRT segment IA is received, it is immediately gray-scale converted into segments 1A, 2A, 3A, 4A for the four LCD frames. Segment 1A is immediately displayed, while segments 2A, 3A, 4A are displayed on the flat panel during the next three LCD frame periods.

All four segment-blocks of data for segment A have been sent to the flat panel for display by time 50, so this storage is available for segment A of the next CRT frame. Any segment-blocks displayed after time 50 must be stored in the buffer memory. Thus segment-blocks 4B, 3C, 4C, and 2D, 3D, 4D must be stored while earlier segment-blocks can be discarded. The six segment-blocks are each one-quarter of a frame in size, so the total memory required is 1.5 frames.

Thus timing overlap can greatly reduce the memory required for the flat-panel buffer. Small staging registers can be used to pipeline the incoming or outgoing data to improve this timing overlap.

3x Frame Acceleration With 3-Segment Display

Figure 11:
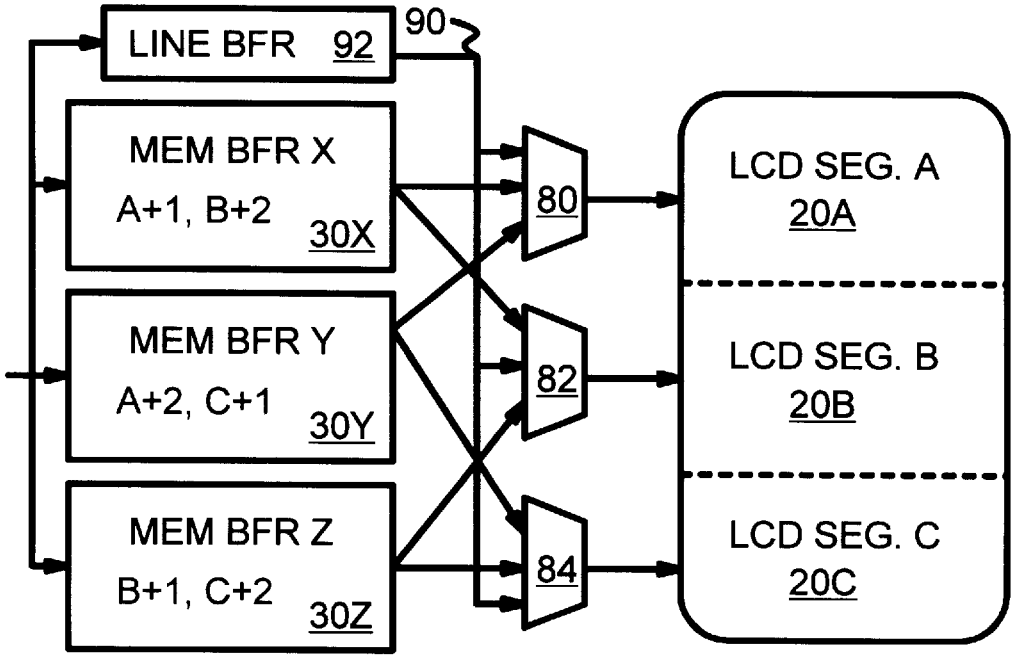
FIG. 11 is a block diagram of a flat-panel display system using three virtual or physical segments.

FIG. 11 is a block diagram of a flat-panel display system using three virtual or physical segments. Graphics data from the CRT pipeline is converted to gray scales (on/off pixels). As the converted pixels are received, they are written to each of the three segments of the flat-panel display in succession. At the beginning of the CRT (input) frame, the data is sent over bypass 90 to mux 80 to be written to upper segment 20A of the flat-panel. Once all lines of upper segment 20A have been written, the data from bypass 90 and line buffer 92 is sent through mux 82 to middle segment 20B. Finally the CRT-frame data is sent over bypass 90 through mux 84 to lower segment 20C.

The data from each input CRT frame is converted to three LCD frames. As each line of segment A is being sent over bypass 90, lines of LCD pixels for the next two frames are written to memory buffers 30X, 30Y, 30Z. The next frame, A+1, is written to buffer 30X, while the following frame A+2, is written to buffer 30Y. Once all lines from bypass 90 are written to segment 20A, then mux 80 switches and writes all lines for the next LCD frame A+1 from buffer 30X. Once these lines have been written, mux 80 switches to display lines from the following frame A+2 from buffer 30Y. Thus segment 20A is written by three LCD frames of pixels for each CRT input frame. The two following frames for segment A, designated A+1 and A+2, are stored in buffers 30X and 30Y. Mux 80 selects the direct data from bypass 90 for the first LCD frame, then from buffer 30X for the next LCD frame, and then from buffer 30Y for the following LCD frame. After all lines from buffer 30Y for the following LCD frame are written, the direct CRT data has cycled through all lines in segments 20B, 20C and is ready to begin an new CRT frame with segment 20A, repeating the cycle. When the CRT data from bypass 90 is being written to segment 20B, the next two frames for segment B, B+1, B+2, are written to buffers 30Z, 30X. Buffer 30X reads out the data for segment A's frame A+1 and sends it through mux 80 to segment 20A at the same time that data for segment B's frame B+2 is being written in. Read-modify-write memory cycles can be used. Likewise segment C's frame C+2 data is read out from buffer 30Z to segment 20C at the same time that segment B's frame B+1 is being written in to buffer 30Z.

Once all lines of segment B have been written from bypass 90 to segment 20B, muxes 80, 82, 84 all switch to their third (lower) inputs. Then the CRT data from bypass 90 is sent to segment 20C, while segment 20A is driven with frame A+2 by buffer 30Y through mux 80, and segment 20B is driven with frame B+1 from buffer 30Z through mux 82. The next two frames for segment C (C+1, C+2) are generated and input to buffers 30Y, 30Z.

Each of buffers 30X, 30Y, 30Z are one-half-frame in size. A total of 1.5 frames of memory storage is required for 3x frame acceleration using physical segments. Virtual segments may requires an extra line of buffering.

3x Segment Frame Acceleration Display Sources—FIG. 12A

FIGS. 12A, 12B are tables showing how data is stored in memory buffers and displayed to a flat-panel display with three virtual segments. FIG. 12A shows how data from the buffers are sent to the display, while FIG. 12B shows how data is stored in the memory buffers of FIG. 11. Successive LCD frames are shown in each column, while the frame data displayed or stored in each of the three segments are shown in the rows.

The data stream to the CRT is used to generate the LCD display data on the fly for the upper segment (segment A) during LCD frame 1. In frame 2, the CRT data is sent directly to the middle segment (B), while in LCD frame 3, the CRT data is sent to the bottom segment (C). This pattern repeats for each following groups of three LCD frames generated from each CRT frame. LCD frames 1,2,3 are generated from the first CRT frame, while LCD frames 4,5,6 are generated from the next CRT frame, and LCD frames 7,8,9 are generated from the following CRT input frame. Of course, the direct CRT data is converted to gray-scale format before being displayed, whether the direct CRT data or the data stored in the memory buffers.

During LCD frame 1, the middle segment B is driven by data that was stored one LCD frame ago (−1), while the bottom segment C is driven by data that is two LCD frames old (−2). During LCD frame 2, segment A is driven by data +1 generated during frame 1, while segment C is driven by data −2 generated two frames ago. During frame 3, segment C is driven directly by the CRT, while segment A is driven by the data A+2 stored two frames ago (during frame 1) and segment B is driven by the data B+1 generated one frame ago (during frame 2).

The pattern repeats itself every three LCD frames, with the direct CRT driving each one of the three segments and generating the next two frames for that segment. The next two frames are stored in the memory buffer and read out during the next two frames when direct CRT data is not available for that segment.

Memory Buffer Contents—FIG. 12B

FIG. 12B shows how data is stored in the memory buffers for 3x frame acceleration. Successive LCD frames are shown in each column, while the frame data stored in each of the three memory buffers are shown in the rows. The read and write activity to each memory buffer is shown in the split columns for each LCD frame. Time increases with the increasing LCD frame number.

During LCD frame 1, the CRT data is sent directly to the upper segment A. This is indicated in the row "CRT-to-LCD Direct Path" which is bypass 90 of FIG. 11. Memory buffers are not used for this data. During frame 2 data for segment B is sent over the direct path to the display, while in frame 3 data for segment C is sent directly to the display. In frame 4 the cycle repeats itself, with the CRT data going directly to upper segment A.

During frame 1, the memory buffers are read to fetch data for segments B and C. Data B-1 is read from buffer X (30X of FIG. 11) and sent to the display, while data C-2 is read from buffer Y (30Y of FIG. 11) and sent to segment C of the flat-panel display. Memory buffer Z contains data C-1 that is not read until the next frame. The parenthesis indicates that the data is stored in the memory buffer but not read out.

The next two frames of segment A, A+1, A+2, are generated from the CRT data during frame 1 and stored (written) to memory buffers X, Y. The new data for segment A is written to buffers X, Y as the old data for segments B,C are being read out. This minimizes memory requirements.

During LCD frame 2, data A+1 is read out of buffer X but data A+2 not disturbed in buffer Y until it is read in frame 3. Data C-1 is read from buffer Z for display to segment C. The new data B+1, B+2 is written to buffers Z, X respectively, for display in frames 3 and 4.

In LCD frame 3, segments A, B are read from buffers Y,Z, which are over-written by new data C+1, C+2. In frame 4, new data A+1, A+2 over-writes buffers X,Y as data B+2, C+1 are read out and displayed.

As can be seen, buffer X alternately stores data A+1 and B+2, while buffer Y stores A+2 and C+1. Buffer Z stores data B+1, C+2. The start-up data B-1, C-2, C-1 is equivalent to B+2, C+1, C+2 respectively.

4x Frame Acceleration With 4 Virtual Segments

Figure 13:
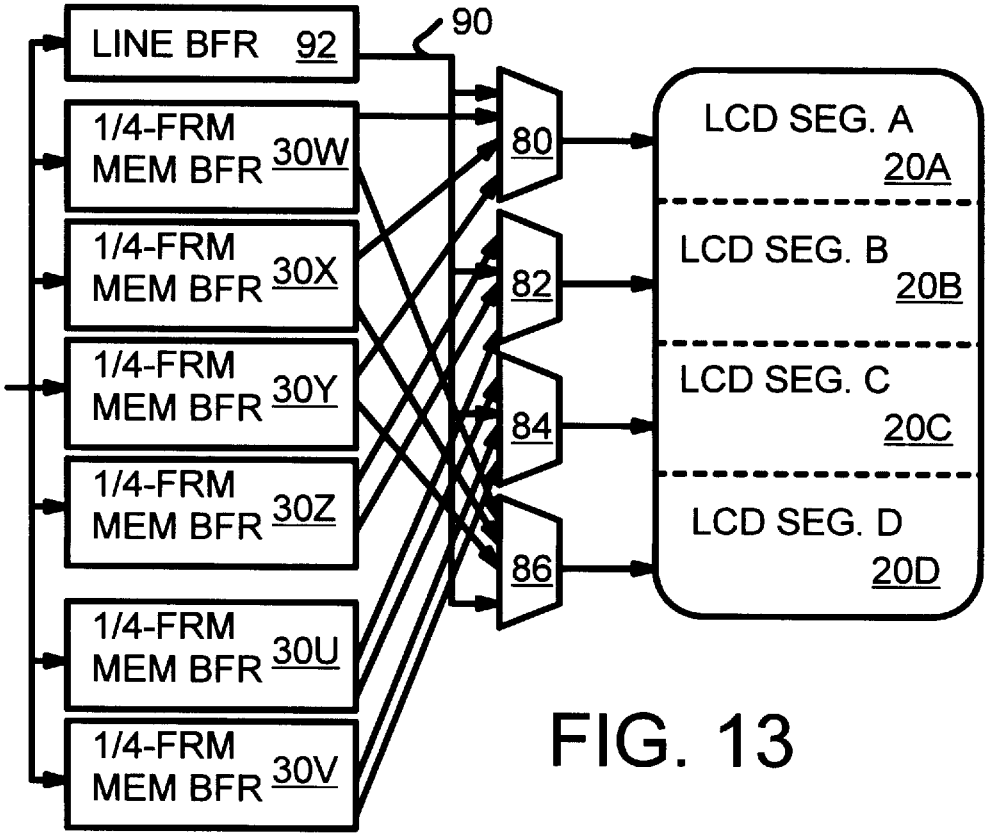
FIG. 13 is a block diagram of a flat-panel display system using four virtual segments.

FIG. 13 is a block diagram of a flat-panel display system using four virtual segments. Graphics data from the CRT pipeline is converted to gray scales (on/off pixels). As the converted pixels are received, they are written to each of the four virtual segments 20A, 20B, 20C, 20D of the flat-panel display in succession. At the beginning of the CRT (input) frame, the data is sent through line buffer 92, over bypass 90 to mux 80 to be written to upper segment 20A of the flat-panel. Once all lines of upper segment 20A have been written, the data from bypass 90 is sent through mux 82 to middle segment 20B, then through mux 84 to middle segment 20C. Finally the CRT-frame data is sent over bypass 90 through mux 86 to lower segment 20D.

Each of buffers 30U, 30V, 30W, 30X, 30Y, 30Z are one-quarter of an LCD frame in size, able to drive one of the four virtual segments for one frame. The four virtual segments 20A-20D are driven simultaneously for each LCD frame. When CRT data is sent directly to a segment through line buffer 92, the three following frames for that segment are generated and stored in three of the quarter-frame buffers 30U–30Z. In the following three LCD frames, these three buffers drive their data to the segment.

Storage required is three frames for the newly-generated data of the segment being displayed directly from CRT data, two frames for the segment that was displayed directly in the last LCD frame, and one segment for the segment that was displayed two LCD frames ago, and that will be displayed directly from the CRT input frame in the next LCD frame. A total of 3+2+1 or 6 quarter-frames of memory are needed. X-1 general, the number of segment buffers required for frame acceleration of X is X-1 factorial, or (X-1)!. Since each segment buffer is 1/X of an LCD frame in size, the memory required is (X-1)!/X of an LCD frame.

An extra line buffer is needed when the segments are virtual rather than physical segments. A standard flat-panel with two halves (two physical segments) can be driven with four virtual segments by driving the lines for the two upper segments in order to the upper half, and the two lower virtual segments in order to the lower half. The line buffer stores the incoming CRT data when the buffered data is being sent to the display.

4x Segment Frame Acceleration Display Sources—FIG. 14

FIG. 14 is a table showing how data is displayed to the flat-panel display system of FIG. 13 with four virtual segments. Successive LCD frames appearing in time are shown in each column, while the frame data displayed or stored in each of the four virtual segments are shown in the rows.

The data stream to the CRT is used to generate the LCD display data on the fly for the upper segment (segment A) during LCD frame 1. In LCD frame 2, the CRT data is sent directly to the middle segment (B), while in LCD frame 3, the CRT data is sent to middle segment C. Finally, during LCD frame 4, the direct CRT data is sent to the bottom segment (C). This pattern repeats for each following groups of four LCD frames generated from each CRT frame. LCD frames 1,2,3,4 are generated from the first CRT frame, while LCD frames 5,6,7,8 are generated from the next CRT frame, and LCD frames 9,10,11,12 are generated from the following CRT input frame. The direct CRT data is converted to gray-scale format before being displayed, whether the direct CRT data or the data stored in the memory buffers 30U–30Z of FIG. 13.

During LCD frame 1, the middle segment B is driven by data that was stored one LCD frame ago (−1), middles segment C is driven by data that is two LCD frames old (−2), and bottom segment D is driven by data generated three frames ago (−3). During LCD frame 1, data for segment A for the next 3 LCD frames (+1, +2, +3) is generated and stored in the memory buffers. Data +1 is sent to segment A for display in frame 2, data +2 is sent to segment A for display during frame 3, and data +3 is sent to segment A for display during LCD frame 4. In frame 5 the direct CRT data again drives segment A and three more frames for segment A are generated and stored for display during frames 6, 7, 8.

During LCD frame 2, segment A is driven by data +1 generated during frame 1, while segment C is driven by data −3 generated three frames ago and segment D is driven by data −2 generated two frames ago. During frame 3, segment C is driven directly by the CRT, while segment A is driven by the data A+2 stored two frames ago (during frame 1) and segment B is driven by the data B+1 generated one frame ago (during frame 2). Segment D is driven by data −3 generated three frames ago. Finally, during LCD frame 4, the CRT data directly drives segment D, data D+1, D+2, D+3 are generated and stored, and segments A, B, C are driven with data A+3, B+2, C+1 stored in memory.

The pattern repeats itself every four LCD frames, with the direct CRT driving each one of the four segments and generating the next three frames for that segment. The next three frames are stored in the memory buffers and read out during the next three frames when direct CRT data is not available for that segment.

The total number of 1/N-frame buffers for the segment blocks is $(N^2-N)/2$, while the total memory required is $(N-1)/2$ frames.

Odd Frame Acceleration—FIG. 15

FIG. 15 shows 5x frame acceleration using 2.5x data acceleration and 2x data repeat. In this example, the display is divided into 5 virtual segments A, B, C, D, E. The middle segment (C) is half in the upper panel and half in the lower panel. Data is repeated for two LCD frames rather than generated and stored for each LCD frame.

The top row of the table shows the CRT frame being input to the gray-scale converter and the segment within each frame. Each column represents one LCD refresh period. Since the frame acceleration is 5x, every five columns are one CRT refresh period. The CRT frames are designated by roman numerals while the segments are designated by letters A, B, C, D, E. Thus the second segment of the second CRT frame is II(A).

The second row of the table shows the LCD frames and segment that are being generated by the gray-scale converter and stored to the buffer memory. LCD frames are designated by Arabic numbers. From segment A of CRT frame I, I(A), LCD segment-blocks 2A, 3A, 4A are generated for segment A, LCD frames 2, 3 and 4. Segment-blocks for LCD frames 2, 3 and 4 are also generated during the next four periods for segments B, C, D from CRT frame I as shown in the table.

The next five rows show which segment-blocks are being sent from the buffer memory to the flat-panel display during that column's time period. While the second row shows the input to the buffer memory, the third through sixth rows show what is output from the buffer memory in each time period. For segments A and B, segment-blocks from the buffer memory for LCD frame 1 are sent to the display during the first LCD refresh period of CRT frame I, while segment-blocks for LCD frame 2 are sent to the display for the next two LCD refresh periods of CRT frame I.

The last row shows the amount of memory required for the LCD buffer. The number of segment-blocks of memory is shown. Each segment-block is one fifth of an LCD frame in size, or 1/(number of segments in a frame). The number of segment-blocks of memory includes the segment-blocks being displayed plus those blocks stored in memory but not yet sent to the flat-panel display.

The number of segment-blocks generated varies among the LCD refresh periods. For example, in period I(A), three segment-blocks, 2A, 3A, 4A, are generated and stored, since LCD frames 2 and 3 are displayed before the next input for segment A at time II(A). Segment-block 4A must also be ready for display at the beginning of period II(A), so a total of three segment-blocks must be generated and stored at time I(A).

While 3 blocks were generated at time I(A) for CRT frame I, only two blocks need to be generated for the next CRT frame II and time 11(A). Thus for every 2 CRT refreshes, five LCD frames are generated, for a data acceleration of 5/2 or 2.5.

For the period, I(B), only two blocks, 3B, 4B, are generated and stored since segment-block 2B is already in storage. Two and then three segment-blocks are alternately generated and stored in alternating periods. LCD frames displayed are repeated, so 2.5 LCD frames must be generated from each CRT frame on average. Sometimes 2 LCD frames are generated for a segment, while for other segments and at other times 3 LCD frames are generated.

The total number of segment-blocks of storage required varies from 11 to 14. For example, at time II(A), blocks 4A, 5A, 6A, 4B, 3C, 4C, 3D, 4D, 2E, 3E, and 4E are in storage, a total of 11 segment-blocks of memory. At time II(B), the next period, blocks 5B, 6B, and 7B are also generated and stored, but no blocks are released. This increases the number of blocks by three to 14. These segment-blocks are smaller, since each of the five segments is only one-fifth of a frame in size. The maximum memory required is 14/5 or 2 4/5 of a frame.

Memory Requirements—FIG. 16

FIG. 16 is a table comparing buffer memory requirements for various kinds and degrees of frame accelerations. The columns compare the number of LCD frames of buffer memory that are needed for the different acceleration techniques shown in the rows.

Frame acceleration requires that the flat-panel display operate at higher refresh rates than the input frames such as for the CRT. For example, 5x acceleration requires a flat panel that refreshes at five times the CRT rate. For a typical 60 Hz CRT refresh, the flat panel refreshes at 300 Hz for 5x frame acceleration, or 540 Hz for 9acceleration. Standard flat-panels operate at approximately 120 Hz, which is enough for 2x frame acceleration. Higher-refresh-rate panels may become available.

Data acceleration refers to generating multiple LCD frames from each CRT frame. Gray-scaling is performed by turning pixels on and off among the multiple LCD frames to approximate the CRT-pixel's shade. Flicker may be noticed by a viewer if the pixels remain on or off for several sequential LCD frames rather than pulsed on and off each LCD frame. Higher refresh rates of the panel reduce flicker.

Segment-Scan Mode

Panels that allow rows to be accessed out-of-order can take advantage of segment frame and data acceleration. The flat-panel must be able to skip a number of rows equal to the segment size, or be physically divided into the desired number of segments. Such 3+-segment panels are not commercially sold today but could be constructed using the invention.

The amount of buffer memory required for segment acceleration is half of the frame acceleration minus one, or ½*(FA-1), where FA is the frame acceleration factor (4x, 9x, etc.). The second row of the table of FIG. 14 shows that segment frame/data acceleration requires only 1 LCD frame of storage for 3x acceleration, 2 frames for 5x acceleration, 3 frames for 7x acceleration, and 4 frames for 9x acceleration. For higher frame accelerations, this mode is by far the most memory-efficient.

Progressive-Scan Mode

However, most current flat-panel displays cannot support segment acceleration since the rows must be accessed in the exact (progressive) order. The second mode in FIG. 14, progressive frame and data acceleration, uses virtual segments in memory, but re-arranges the data into a progressive order as it is sent to the flat-panel display. More memory buffering is required; about 2 additional frames are needed to re-order the LCD data. Higher-speed panels are still required, but they can operate as standard dual-scan panels.

The memory required for progressive-scan frame and data acceleration is 2 frames plus the memory required for segment acceleration, or 2+½*(FA-1). FIG. 14 shows that progressive frame/data acceleration requires 3 frames rather than one frame for 3x acceleration, 4 frames rather than 2 frames for 5x acceleration, and for 9x acceleration, 6 frames rather than 4 frames as for segment frame/data acceleration. Each is 2 frames more than segment acceleration.

In some of these modes, memory requirements can be reduced by approximately one segment-block. Timing overlap allows one segment-block to be written in with new data as the old data is read out to the flat-panel display.

Achieving More Bandwidth Using Standard Column Drivers

Some displays are limited for higher refresh rates because column driver chips in these display panels cannot be clocked at a high enough rate. One method that can allow these slower column drivers to be used is to split the horizontal column drivers so that each chip is driven simultaneously (or grouped into a left-half and a right-half to achieve a 2x bandwidth improvement). If 10-column driver chips are used in each panel segment, then the left 5 columns can be driven by a separate data path and the right 5 columns can be driven from a different data path. This doubles the data width. In this example the column drivers could be individually driven for all 10 columns, providing a 10x bandwidth improvement. However, the physical routing of such wide data lines may be problematic.

ADVANTAGES OF THE INVENTION

While it might appear at first glance that increased frame and data acceleration would require linear increases in buffer memory, the invention significantly reduces the memory requirements. It logically appears that when additional LCD frames are sent to the flat-panel for each CRT refresh period, memory would be required for each of these LCD frames. Thus 6x frame acceleration would logically require that six LCD frames be generated, stored, and sent to the flat panel.

Instead, the invention requires only 2½ frames for 6x frame acceleration when the display and memory are divided into virtual segments, using the segment acceleration technique. Rather than a one-to-one increase in frame storage for higher frame acceleration, the invention produces a half-to-one increase. Each increase in frame acceleration requires only one-half an additional frame. Thus buffer memory increases at only half the expected rate. Arranging the memory and display into smaller segments results in improved memory efficiency.

A memory reduction of about one-third is achieved for most frame accelerations by repeating frames when using acceleration on progressive-scan panels. This mode is particularly well-suited for current progressive-scan flat-panel displays, and is useful as their refresh rates increase with improving technology. Segment modes are useful for non-standard displays and can reduce memory requirements even more.

Saving a frame of data is significant, even for the relatively compressed LCD frames that use only 3 bits per pixel. For example, a VGA frame 307,200 pixels and uses 0.9 MB of memory. SVGA (800×600) has 480,000 pixels and each LCD frame is 1.4 MB. XGA frames use 2.25 MB while SXGA frames use 3.75 MB.

ALTERNATE EMBODIMENTS

Several other embodiments are contemplated by the inventors. Many other combinations of data and frame acceleration are possible, and the repeat factor can be increased beyond the factor of two used in the examples. Higher frame accelerations are contemplated. The number of segments and their size can be varied. Segments of differing sizes within a panel are even possible. Interleaving of rows can be used. An additional set of row-drivers could be employed to drive the panel from left and right sides. In this case the rows could be split and even refreshed at different times.

Pipelining can change the exact times and relationships of various data streams. For example, pipelining registers in the CRT path after the gray-scale converter input cause the CRT to be refreshed at a slightly later time relative to the LCD. The tables and examples show the CRT datastream at the point the gray-scale converter input is taken. Similar pipeline delays in the LCD path can delay the actual LCD refresh relative to that indicated in the tables. Indeed, delays in the flat-panel itself are common as well. The tables are intended to emphasize the input and output of data at the buffer memory.

Of course, the CRT can be disabled as it often is for laptop PCs. Indeed, no connection to a CRT is necessary. The term CRT frame has been used as the input frame while the LCD frame is the output frame for frame acceleration, but other display configurations are possible. While CRT frames are commonly used today as the input frame, it is possible that future systems will have the LCD frame or some other display frame as the input frame or output frame.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A graphics system with reduced memory requirements comprising:

a gray-scale converter for N-frame acceleration, the gray-scale converter generating N LCD frames from each CRT frame, wherein N is a whole number greater than two;

buffer memory means for storing the N LCD frames;

a plurality of $(N^2-N)/2$ segment buffers, in the buffer memory means, each segment buffer containing 1/N of an LCD frame of pixels;

multiplexing means, coupled to the buffer memory means, for sending each LCD frame to a flat-panel display;

whereby LCD frames are refreshed at an accelerated rate compared with a CRT-frame refresh rate by generating multiple LCD frames.

2. The graphics system of claim 1 wherein the buffer memory means includes (N−1)/2 LCD frames of storage.

3. The graphics system of claim 1 wherein the flat-panel display is divided into N physical segments, wherein N is greater than two.

4. The graphics system of claim 1 wherein the flat-panel display is divided into N virtual segments, wherein N is greater than two.

5. The graphics system of claim 1 further comprising:

a line buffer, coupled from the gray-scale converter to the multiplexing means, for bypassing the buffer memory means for a current segment being displayed by the flat-panel display.

6. The graphics system of claim 5 wherein the gray-scale converter divides each CRT frame into N incoming segments;

wherein the line buffer sends each of the N incoming segments to the flat-panel display through the multiplexing means for direct display on a corresponding segment of the flat-panel display;

wherein the incoming segment being directly displayed is a current segment;

wherein the gray-scale converter generates other LCD frames of the current segment, wherein the other LCD frames generated are stored in the buffer memory means;

wherein the multiplexing means sends other LCD frames for segments other than the current segment to the flat-panel display, whereby LCD frames for the current segment are generated and stored for later display.

7. A method for acceleration of pixel transfer to a flat-panel display, the method comprising:

during a first time-period of an input frame:

transferring pixels from the input frame to a first segment of the flat-panel display for immediate display;

storing pixels from the input frame for the first segment in a first segment-memory for display in a second time-period;

storing pixels from the input frame for the first segment in a second segment-memory for display in a third time-period;

transferring pixels stored at least two time-periods earlier to a second segment of the flat-panel display from the first segment-memory;

transferring pixels stored at least one time-period earlier to a third segment of the flat-panel display from the second segment-memory;

during a second time-period of the input frame:

transferring pixels from the input frame to a second segment of the flat-panel display for immediate display;

storing pixels from the input frame for the second segment in the first segment-memory for display in the first time-period of a next input frame;

storing pixels from the input frame for the second segment in a third segment-memory for display in a third time-period;

transferring pixels stored at least one time-period earlier to the first segment of the flat-panel display from the first segment-memory;

transferring pixels stored at least two time-periods earlier to the third segment of the flat-panel display from the third segment-memory;

during a third time-period of the input frame:

transferring pixels from the input frame to the third segment of the flat-panel display for immediate display;

storing pixels from the input frame for the third segment in the second segment-memory for display in the first time-period of a next input frame;

storing pixels from the input frame for the third segment in the third segment-memory for display in a second time-period of a next input frame;

transferring pixels stored at least one time-period earlier to the second segment of the flat-panel display from the third segment-memory; and transferring pixels stored at least two time-periods earlier to the first segment of the flat-panel display from the second segment-memory;

whereby at least three segments of the flat-panel display are refreshed using three segment memories.

8. The method of claim 7 further comprising:

using a gray-scale converter to generate on/off pixels from the input frame for display on the flat-panel display and for storage by the first, second, and third segment-memories.

9. The method of claim 8 wherein each segment-memory stores one-third of an input frame of pixels.

10. The method of claim 7 further comprising:

reading out pixels from a current segment-memory for display on the flat-panel display while writing new pixels to the current segment-memory for storage and display during a later time-period, whereby the current segment-memory is both read and written during a current time-period.

11. The method of claim 10 wherein pixels for immediate display are buffered by a line buffer for storing a horizontal line of pixels.

12. A method for N-frame acceleration to a display of N segments, the method comprising:

during each of N time-periods:

transferring pixels from a current segment of an input frame to a current segment of the display;

storing pixels from the current segment of the input frame in a memory containing $(N^2-N)/2$ segment-buffers, the pixels stored for display in a subsequent N−1 time periods in N−1 segment-buffers;

reading stored pixels from N−1 segment-buffers that were stored in a previous N−1 time-periods;

transferring the stored pixels to the display to all N−1 segments of the display except the current segment; and advancing to a next current segment of the input frame, and when the current segment is a last segment of the input frame, advancing to a first segment of a next frame, whereby N segments are refreshed for each of N time-periods.

13. The method of claim 12 wherein a different group of N−1 segment-buffers are read and written for each time-period of the input frame.

14. The method of claim 12 further comprising:

reading and writing to a segment-buffer during a current time-period, whereby stored pixels are read out of segment-buffers as new pixels are being written in.

15. The method of claim 14 wherein N is three, the method repeating for N=3 time-periods.

16. The method of claim 14 wherein N is four, the method repeating for N=4 time-periods.

17. The method of claim 14 wherein N is greater than four, the method repeating for N time-periods.

* * * * *